US010495377B2

(12) United States Patent
Linney, II

(10) Patent No.: US 10,495,377 B2
(45) Date of Patent: Dec. 3, 2019

(54) REFRIGERATED ENCLOSURE WITH AUTOMATED MONITORED REFRIGERATED PRODUCT SAFE HEALTH USER ACCESS CONTROL

(71) Applicant: Royal Vendors, Inc., Kearneysville, WV (US)

(72) Inventor: Robert Joseph Linney, II, Winchester, VA (US)

(73) Assignee: ROYAL VENDORS, INC., Kearneysville, WV (US)

( * ) Notice: Subject to any disclaimer, the term of this patent is extended or adjusted under 35 U.S.C. 154(b) by 738 days.

(21) Appl. No.: 14/896,903

(22) PCT Filed: Jun. 11, 2014

(86) PCT No.: PCT/US2014/041959
§ 371 (c)(1),
(2) Date: Dec. 8, 2015

(87) PCT Pub. No.: WO2014/201148
PCT Pub. Date: Dec. 18, 2014

(65) Prior Publication Data

US 2016/0169578 A1 Jun. 16, 2016

Related U.S. Application Data

(60) Provisional application No. 61/833,493, filed on Jun. 11, 2013.

(51) Int. Cl.
*F25D 29/00* (2006.01)
*F25D 23/02* (2006.01)

(52) U.S. Cl.
CPC ..... *F25D 29/006* (2013.01); *F25D 23/028* (2013.01)

(58) Field of Classification Search
CPC ..... F25D 23/028; F25D 29/006; F25D 11/04; E05B 65/0042
See application file for complete search history.

(56) References Cited

U.S. PATENT DOCUMENTS

2005/0188715 A1* 9/2005 Aragon ..... F25D 3/125 62/371
2006/0225443 A1* 10/2006 Tamborra ..... G01K 3/04 62/157

(Continued)

FOREIGN PATENT DOCUMENTS

| | | |
|---|---|---|
| EP | 1245914 A2 | 10/2002 |
| RU | 102986 U1 | 3/2011 |
| RU | 2478363 C1 | 4/2013 |

OTHER PUBLICATIONS

International Search Report from corresonding International Application No. PCT/US2014/041959 dated Sep. 30, 2014.

*Primary Examiner* — David J Teitelbaum
(74) *Attorney, Agent, or Firm* — Westerman, Hattori, Daniels & Adrian, LLP

(57) ABSTRACT

A refrigerated cooler for storing food and other applications having a controller and a temperature sensor that monitors the temperature inside the food compartment and compares the monitored temperature to a stored predetermined temperature and a controller controlled door lock that is placed in the lock position by the controller if the monitored temperature is compared to be greater than the stored predetermined temperature or if the supply of power to the cooler is interrupted to restrict a customer's access to the food inside that may be unsafe due to the monitored temperature being greater than the stored predetermined temperature.

31 Claims, 7 Drawing Sheets

(56) References Cited

U.S. PATENT DOCUMENTS

| | | | | |
|---|---|---|---|---|
| 2010/0300130 | A1* | 12/2010 | Shoenfeld | A61B 50/10<br>62/129 |
| 2014/0202220 | A1* | 7/2014 | Denison et al. | E05B 43/005<br>70/267 |

* cited by examiner

REFRIGERATED ENCLOSURE WITH AUTOMATED MONITORED REFRIGERATED PRODUCT SAFE HEALTH USER ACCESS CONTROL

RELATED APPLICATION

This application is a National Stage of International Application No. PCT/US2014/041959, filed Jun. 11, 2014, which claims priority to US Provisional App. No. 61/833493 filed Jun. 11, 2013, each of which are incorporated herein by reference.

TECHNICAL FIELD

The present invention relates generally to refrigerated coolers and more specifically to refrigerated coolers that prevent access to contents of the cooler when the temperature of the cooler has risen above a safe value.

BACKGROUND ART

Coolers that have a refrigeration system and maintain the food inside at a pre-recorded limits are known in the industry. Industry standards require that certain foods be refrigerated. Still further, some foods are unsafe for human consumption when their temperature during storage rises above a certain temperature. There has also been in increase in the number of unattended and lightly staffed micro-sites where human monitoring of food storage temperature may be insufficient.

There is a need in the industry for a cooler that automatically prevents access to the food items when their temperatures have risen above a certain temperature.

SUMMARY OF THE INVENTION

The present invention provides a cooler equipped with a temperature sensor for monitoring the temperature inside the cooler. When the temperature drops below a minimum level for more than a predetermined length of time, the cooler controller locks the door and prevents access to the food stored inside. The situation usually occurs when the cooler's power supply fails or refrigeration system quits working.

Another aspect of the invention relates to the type and construction of the front door lock. A common type of lock will lock the door when the power is interrupted and remains locked until the power is restored and a reset condition occurs. The improvement provided will only open the door if health conditions are maintained.

Another aspect of the invention relates to the construction of the latch-solenoid-lock combination that is used to lock the cooler door when health safety hazards occur.

DETAILED DESCRIPTION OF THE PREFERRED EMBODIMENT

Figure 1:
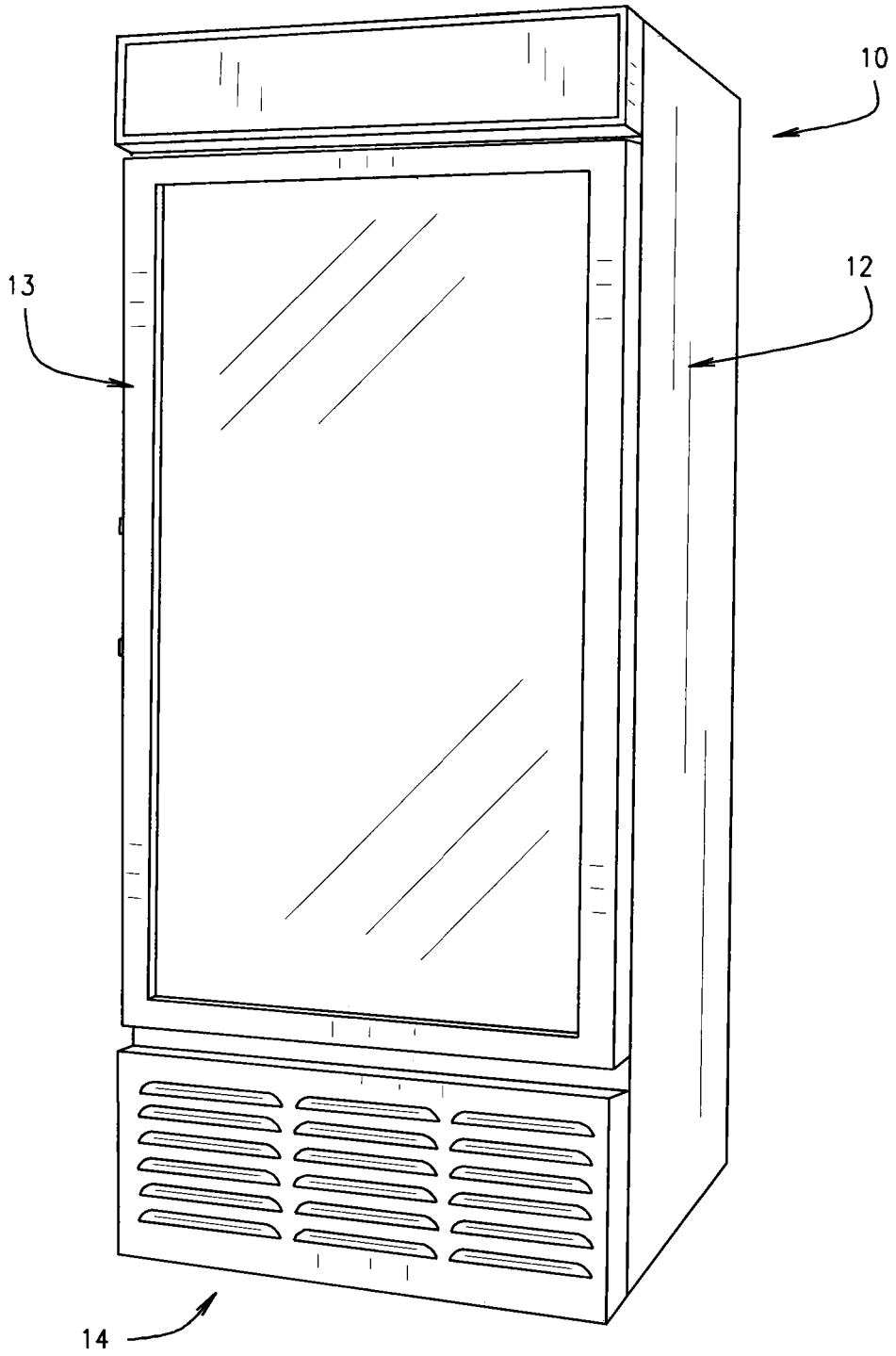
FIG. 1 shows a refrigerated cooler according to an embodiment of the invention.

FIG. 1 shows a cooler 10 according to an embodiment of the invention. The cabinet 12 is durable and is made of high density material, foamed-in-place; one-piece cabinet 12 provides maximum degree of structural integrity. The standard configuration has 6-shelves with a full-length glass cooler door 13; there are also models with 5-shelves. Not visible in FIG. 1 are shelves equipped with beverage can/bottle guides, as is known in the art.

The cabinet 12 is built strong such that multiple coolers 10 can be stacked three high thereby optimizing inventory storage space. Grills 14 are made of heavy gauge steel for durability.

The cabinet 12 is easy to maintain. The cooler 10 further comprises a refrigeration module capable of easily be sliding in and out for ease of cleaning and replacement.

Ideally, a temperature control for controlling the internal temperature of the cooler 10 is not visible to a loader or customer, discouraging unnecessary adjustment.

Illumination lamps are provided that include illumination lamp shields that protect packaged food in the cooler 10 in case of accidental lamp breakage.

There is no exposed wiring on an outside surface of the cooler 10 to optimize safety and cosmetic appearance.

The grill 14 covering the refrigeration module is easy to remove and replace for cleaning and servicing access.

Figure 3:
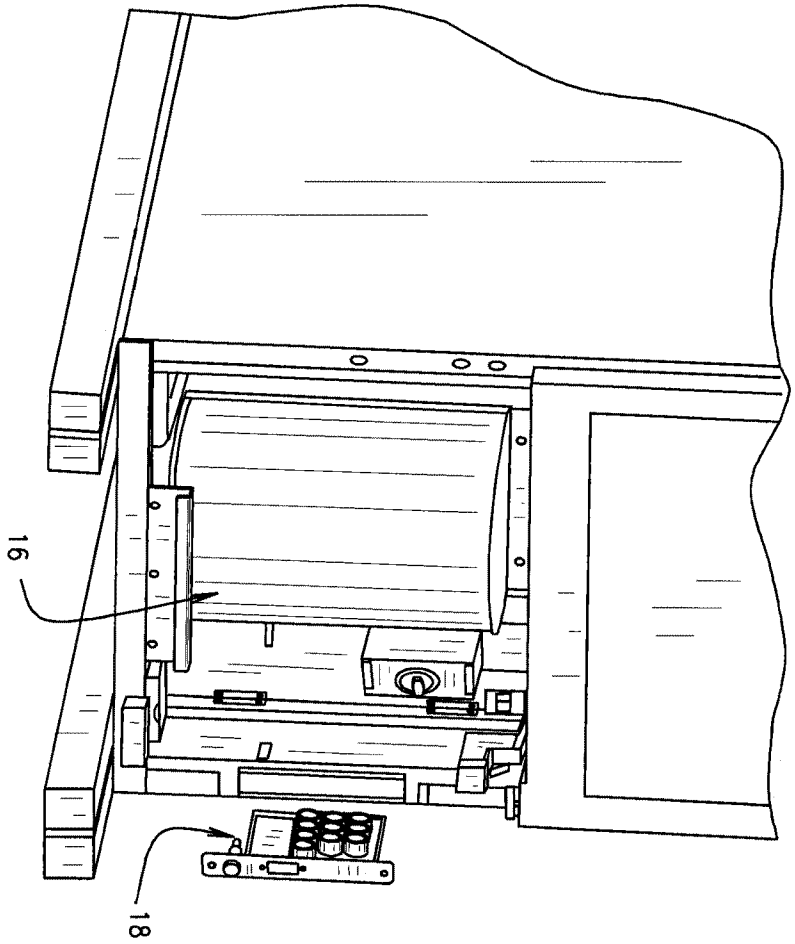
FIG. 3 shows a cooler health safety controller according to an embodiment of the invention.

The refrigeration system module 16 is located behind the grill 14 and is visible in FIG. 3. Cooler operation and the refrigeration cycle is controlled by a health safety controller 18 located next to the refrigeration system module 16 and is visible in FIG. 3. Temperature sensors 20 located inside the cooler 10 monitor the ambient temperature and report it to the health safety controller 18. If the ambient temperature inside the cooler 10 rises above a threshold temperature or if the ambient temperature inside the cooler 10 rises above a threshold temperature for a predetermined amount of time, the health safety controller 18 will lock the cooler door 13 such that the food is inaccessible to a customer. The cooler 10 further includes a sensor 40 that detects whether the door 13 is open or closed.

Figure 5:
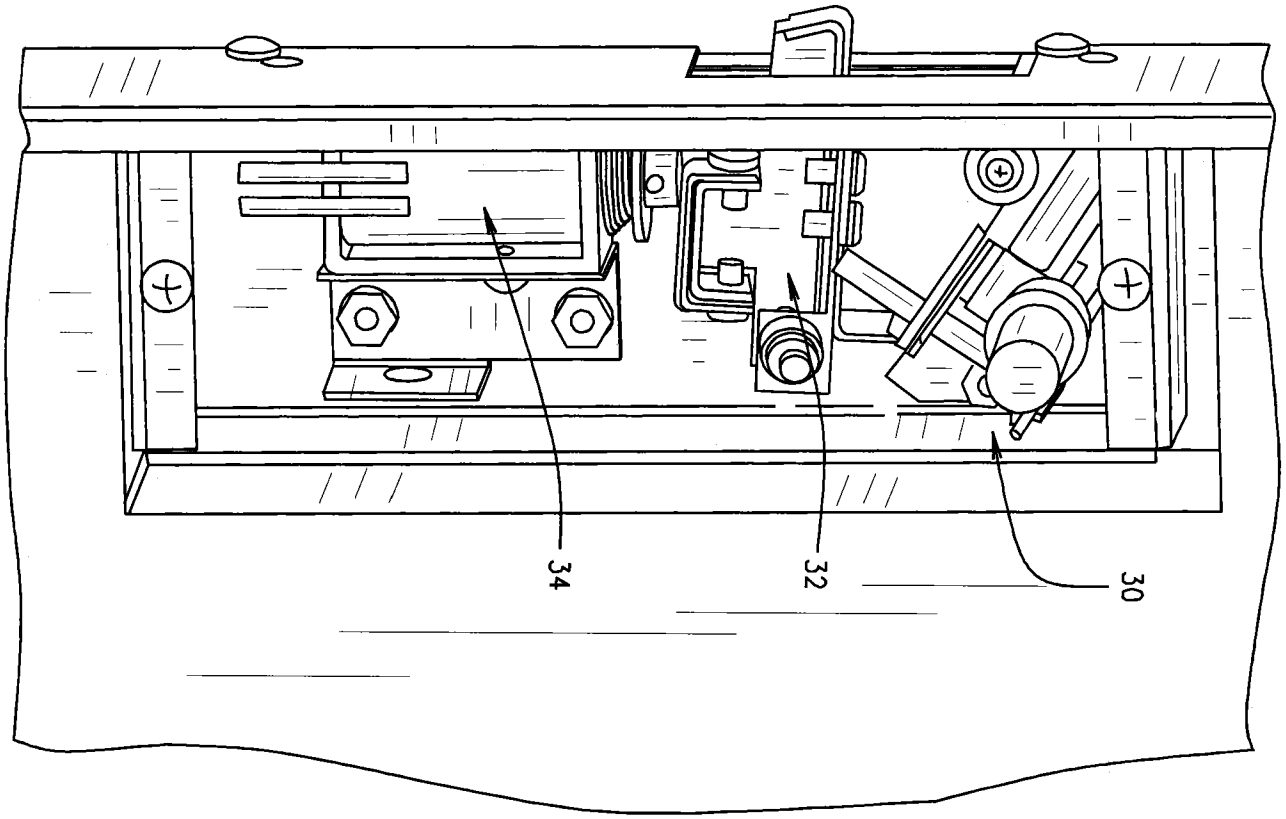
FIG. 5 shows the door latch mechanism in a closed position according to an embodiment of the invention.
Figure 6:
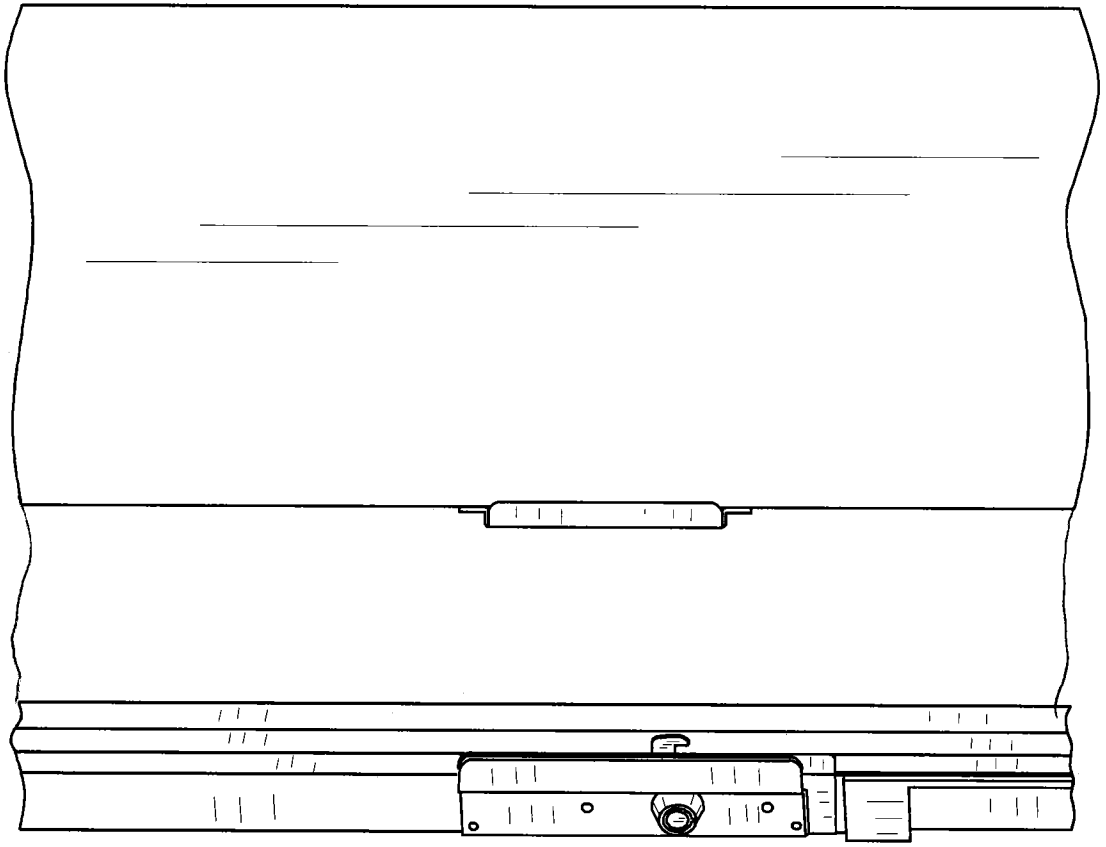
FIG. 6 shows a door latch (hook) according to an embodiment of the invention.
Figure 7:
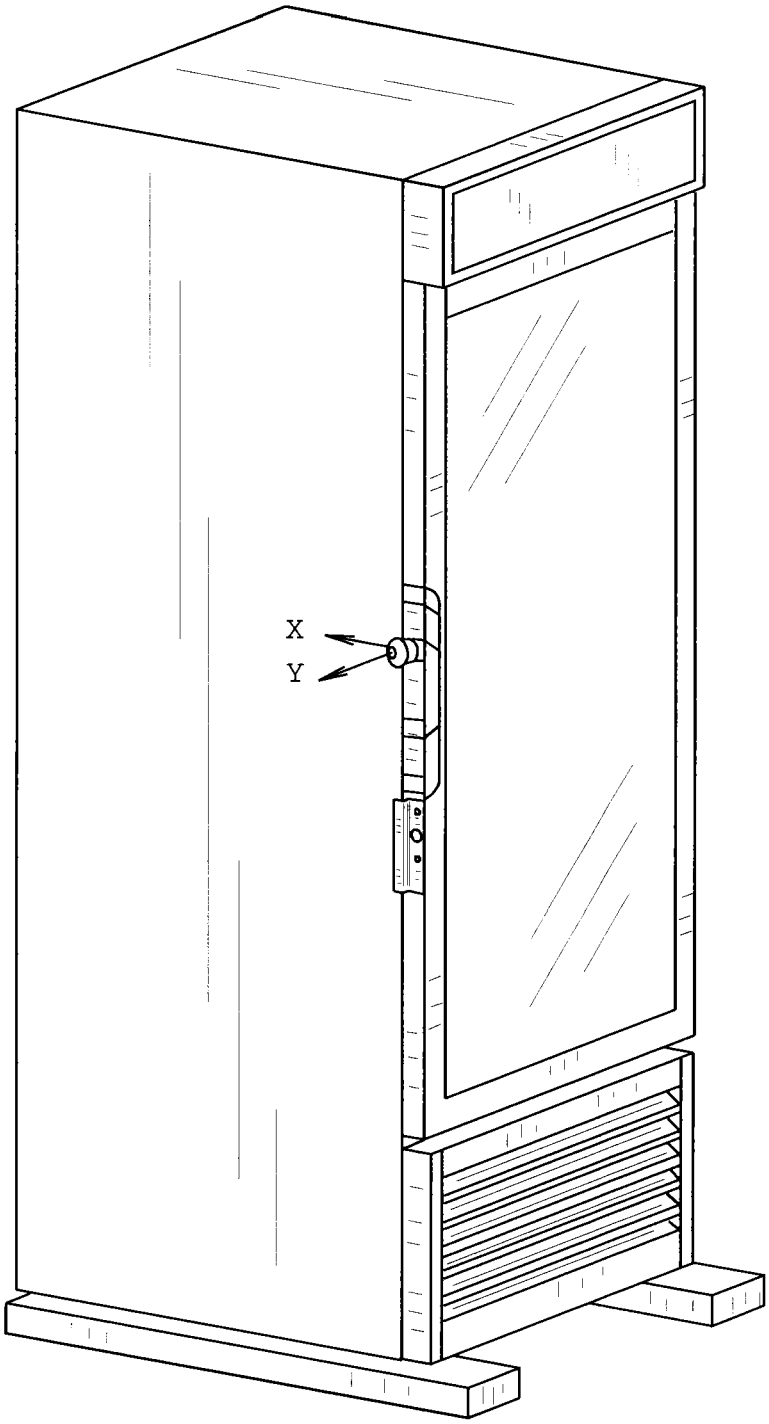
FIG. 7 shows a schematic assembly of the cooler according to an embodiment of the invention.

Referring to FIGS. 5 and 6, the cooler further includes a lock mechanism 30 is mounted to the cooler 10 and has a latch arm 32. The latch arm 32 is controlled by a solenoid 34 that is controlled by the health safety controller 18. The latch arm 32 can be operated to engage a catch 36 mounted to the door 13 to lock the door 13 in a closed position. When the solenoid 34 is energized, the latch arm 32 is lifted, thereby unlocking the door 13. When the solenoid 34 is de-energized the latch arm 32 is lowered to engage the catch 36. In this manner, when the cooler 10 loses power, the door 13 becomes locked. Alternatively, this operation could be reversed so that the cooler door 13 remains unlocked when the cooler 10 loses power.

Alternatively, the solenoid 34 may be powered with a voltage of (+) polarity to close the lock and a voltage of (−) polarity to open the lock. If there is no AC power the solenoid will lose power and will close the lock. The only disadvantage of this construction is that the solenoid will have to continuously sustain 100% of the power; it will have to be a 100% duty cycle solenoid.

If the solenoid 34 function is limited to only latch the lock in the open or closed position the power requirement for the solenoid is much less restrictive and require a more economical solenoid. However, in case of total AC power loss a relatively small power storage means like a capacitor or dc power supply (battery) will be needed in order to pulse the solenoid accordingly.

Figure 2:
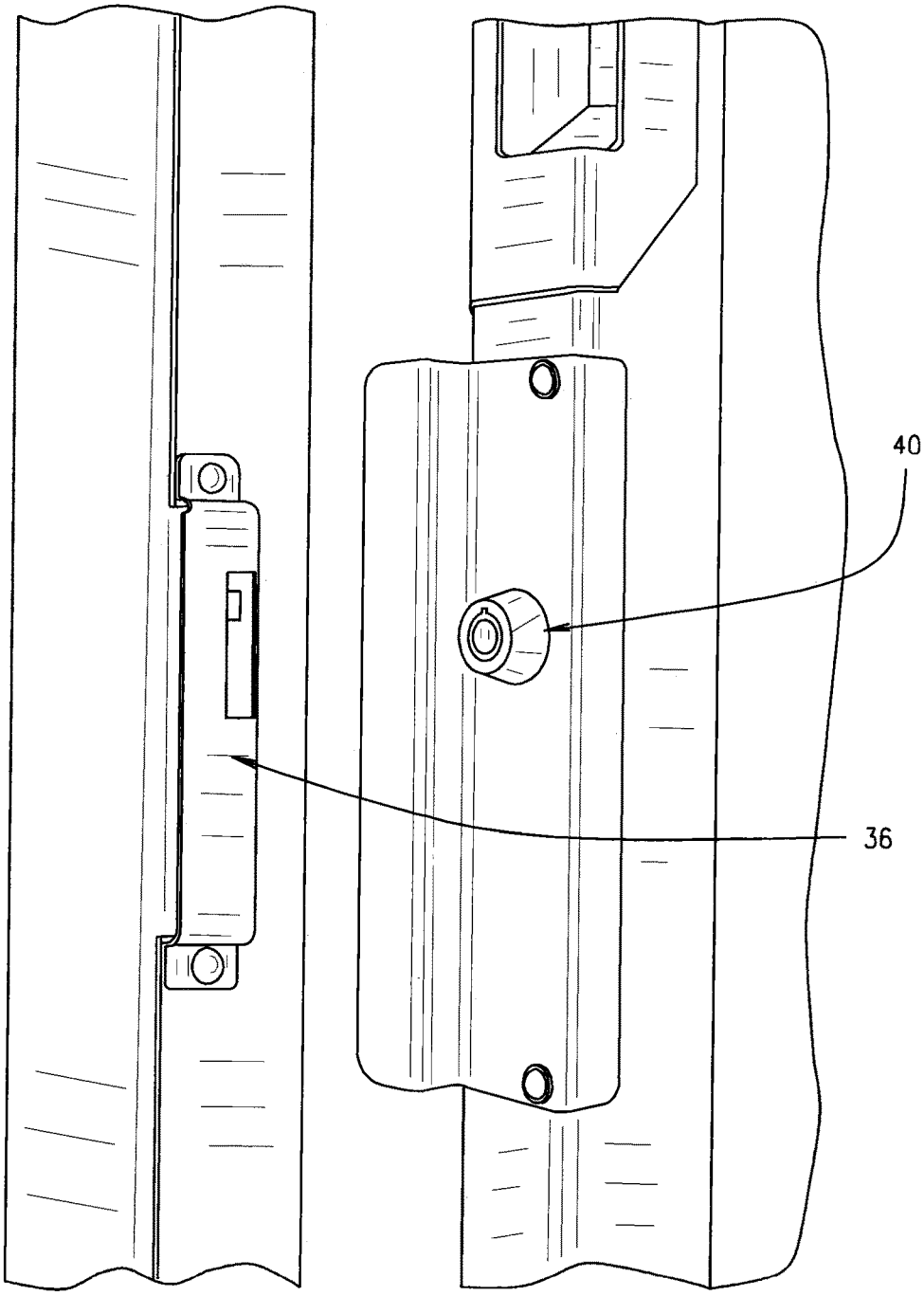
FIG. 2 shows a health timer lock mechanism according to an embodiment of the invention.

A safety release button 38 is further provided that allows person who has become trapped in the cooler to open the cooler door from the inside if the cooler door becomes locked while a person is inside. Further, optionally, a key lock 40 (FIG. 2) may be provided which allows a person to open the cooler door 13 from the outside with a key should the door become locked by the latch arm 32. Such access would allow authorized individuals access to the cooler 10, such as in the case of power failure.

An external release may also be provided for use when supply power is lost to the cooler 10 and access to the inside of the cooler 10 is necessary. To use the external release, one may insert an object, such as a pencil or similar object, into an access hole located on the back of the lock assembly and angle the pencil upward, then push down to release operate the latch arm 32.

The health safety controller 18 operates the solenoid 34 that locks the cooler door 13 that prevents customers from taking food items out of the cooler if the cooler temperature rises above a certain temperature, for example 41 degrees Fahrenheit for a predetermined period, following FDA and NSF guidelines for potentially hazardous prepackaged foods. The health safety controller 18 includes a specialized circuit or processor, software algorithms and logic for monitoring temperature and activating the lock, for example utilizing relays to operate the solenoid 34.

In special cases, the safety controller software algorithm allows for loading the cooler without activating the lock in the event of excessive temperature rise.

A display can optionally be provided to facilitate service personnel setting up the conditions for the health safety controller 18, like temperature limits and durations. The display can be as simple as an LED display or an alphanumeric/images/audio capable display.

The display can also be used to inform the customer of the cooler's 10 status. This may be important when the cooler door 13 is locked for a health issue.

Figure 4:
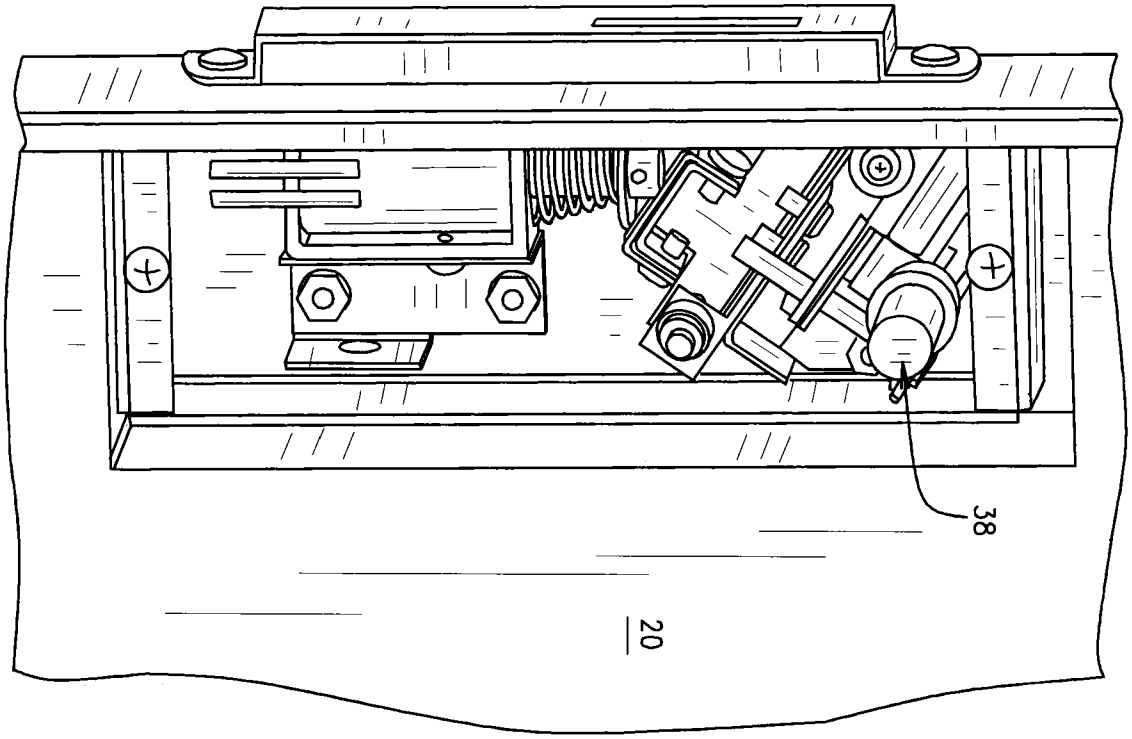
FIG. 4 shows the door latch mechanism in an open position according to an embodiment of the invention.

The cooler 10 and cooler door 13 can optionally be provided without the lock of FIGS. 4 and 5. If there is no lock, the health situation will only be indicated on the display and an audio enunciator may optionally sound. If there is a lock, the door will be locked any time a pre-registered health situation occurs.

Health Safety Controller Operation

1. When the health safety controller 18 is first powered up, a health safety error will occur and will be displayed on the display (if there are only diagnostic LEDs, the LED will be used to indicate the error) and the door solenoid will be supplied with a signal to lock the door. This is intended to prevent access to spoiled food or drinks whenever the previous state of the refrigeration is unknown.

2. To reset the health safety error, the service personnel will press a RESET switch. This will clear all errors, supply a signal to the solenoid to unlock the door and initiate a timer.

3. Upon reset, the controller will enter a "grace" period. At the end of this grace period, the controller will sample the cabinet temperature to see if the temperature is below a predetermined temperature, such as 41° F. (5° C.). The length of this grace period is determined by the state of the door switch at the time the reset button is pressed.

a. If the door is open at the time of reset, the controller will allow a first grace period, for example a 60-minute grace period.

b. If the door is closed, the controller will allow a second grace period, such as a 30-minute grace period.

c. If at the end of the applicable grace period (for example, 30 or 60 minutes) the temperature is not below the predetermined temperature (for example, 41° F. (5° C.)), the controller will trigger a health safety error and signal the solenoid 34 to lock the door and signal the display and/or diagnostic LED to indicate a health safety error.

4. The health safety controller 18 constantly monitors the cabinet temperature. After the initial grace period has expired, the controller will assume normal operation and watch for an unexpected rise in temperature.

a. If the temperature is observed to rise above a predetermined temperature, such as 41° F. (5° C.), the health safety controller 18 will start a timer for a predetermined amount of time, such as 15 minutes.

b. If the temperature remains above the predetermined temperature for more than the predetermined timer length, the health safety controller 18 will trigger a health safety error and signal the solenoid 34 to lock the door 13.

c. If, within the predetermined timer period, the temperature returns below the predetermined temperature, no health safety error will occur.

5. The health safety controller 18 constantly monitors the state of the door switch. If the controller 18 determines that the door switch has cycled (i.e., gone from closed to open or open to closed), the controller will begin a grace period. The length of this grace period will depend upon the state of the door after the transition has occurred.

a. If the door is open after the transition, the health safety controller 18 will allow a predetermined grace period, such as 60 minutes.

b. If the door is closed after the transition, the controller will allow a second predetermined grace period, such as 30 minutes.

c. If the door again cycles during the grace period, the grace period will be reset and the countdown will be based upon the state of the door switch based on rules (a) or (b) above.

d. At the end of the grace period, the cabinet temperature must be at or below the predetermined temperature. If the temperature is above the predetermined temperature, a health safety error will be triggered, the solenoid will be signaled to lock the door and an error will be indicated on the LED an/or display. If the temperature is at or below the redetermined temperature, normal operation will resume.

6. Optionally, the health safety controller 18 further monitors supply power to the cooler 10 with a supply power detector circuit. When supply power is disrupted, the controller will shed all loads (LEDs, sensors, etc.) and signal the solenoid (from a capacitor or battery) to lock the door 13, and the health safety controller 18 will enter into a low-power state of operation. The controller 18 will remain in this low-power state for a predetermined period time, for example 30 minutes, or until AC power returns. If AC power returns before this predetermined period of time has expired, the controller will sample the temperature upon power-up.

a. If the temperature is at or below the predetermined, the controller will return to normal operation and signal the solenoid 34 to unlock the door 13.

b. If the temperature is above the predetermined temperature, the controller will trigger a health safety error and signal the solenoid to lock the door (to ensure the door is still locked).

c. If power is not restored within the predetermined time period, the health safety controller 18 will trigger a health safety error.

The invention claimed is:

1. A refrigerated cooler comprising:

a cabinet having an interior for storing food items requiring refrigeration and a refrigeration unit for cooling the interior of the cabinet;

a controller controlling the refrigeration unit regulating the temperature of the interior of the cabinet, the controller in communication with a temperature sensor that monitors the temperature of the interior of the cabinet and is in communication with the refrigeration unit to control the operation of the refrigeration unit, the controller comparing the monitored temperature with a stored predetermined temperature;

a door attached to the cabinet that selectively provides access to the interior of the cabinet and seals air within the interior of the cabinet;

a door lock including a latching unit and a catch, one of each operatively connected to the cabinet and the door wherein the door lock is adapted to have a lock position and an unlock position responsive to receiving a lock position communication from the controller and wherein in the lock position the lock prevents access to the interior of the cabinet and the stored food items within the interior of the cabinet, the controller generating the lock position communication responsive to the controller determining from the comparing that the monitored temperature of the interior of the cabinet is greater than the predetermined temperature wherein the controller includes a timer determining a present time or a lapsed time and further comprising a door position sensor that determines whether the door is open or closed, the controller operatively connected to the door position sensor and wherein the controller determines a period of time for the door being open and generates the lock position communication responsive to the controller determining the sensed temperature of the interior of the cabinet has remained above the predetermined temperature and the determined door open period of time is greater than a stored predetermined period of door open time.

2. The refrigerated enclosure of claim 1 wherein the door lock includes a solenoid for operating the door lock between the locked position and unlocked position responsive to receiving the communication from the controller.

3. The refrigerated cooler of claim 1 further comprising a power supply detector circuit that determines whether a supply of power to the cooler has been interrupted, the controller operatively connected to the power supply detector circuit and wherein the controller generates an unlock position communication responsive to the supply of power being currently detected and wherein at least one of the controller generates a lock position communication responsive to the detection of the interruption of the supply of power and the door lock automatically transitions to the lock position when the supply of power is interrupted.

4. The refrigerated cooler of claim 3 wherein the controller generates an unlock position communication to the door lock to unlock the door when the controller receives an indication from the power supply detector circuit that the supply of power has been restored to the cooler and the controller determines that the temperature of the interior of the cooler has not remained at being greater than the predetermined temperature for a period of time that is greater than a stored predetermined power interruption period of time.

5. The refrigerated cooler of claim 1 further comprising a display operatively connected to the controller indicating an operating status of the cooler including a status indication of the door being in the lock position.

6. The refrigerated cooler of claim 1 further comprising a safety release button disposed in the interior of the cooler, wherein the safety release button operatively coupled to the door lock unlocking the door lock that is in the lock position independent of the received lock position communication from the controller to allow a person trapped in the cooler to open the door when it is locked.

7. The refrigerated cooler of claim 1 wherein the door lock further comprises a key slot that is accessible external to the cabinet, the key slot operable to manually change the position of the door lock between the lock position and the unlock position enabling a person to unlock the door lock independent of whether a supply of power to the cooler has been interrupted or when the door lock has been placed in the lock position by the controller.

8. A refrigerated cooler comprising:

a cabinet having an interior for storing food items requiring refrigeration and a refrigeration unit for cooling the interior of the cabinet;

a controller controlling the refrigeration unit regulating the temperature of the interior of the cabinet, the controller in communication with a temperature sensor that monitors the temperature of the interior of the cabinet and is in communication with the refrigeration unit to control the operation of the refrigeration unit, the controller comparing the monitored temperature with a stored predetermined temperature;

a door attached to the cabinet that selectively provides access to the interior of the cabinet and seals air within the interior of the cabinet;

a door lock including a latching unit and a catch, one of each operatively connected to the cabinet and the door wherein the door lock is adapted to have a lock position and an unlock position responsive to receiving a lock position communication from the controller and wherein in the lock position the lock prevents access to the interior of the cabinet and the stored food items within the interior of the cabinet, the controller generating the lock position communication responsive to the controller determining from the comparing that the monitored temperature of the interior of the cabinet is greater than the predetermined temperature, wherein the controller includes a timer determining a present time or a lapsed time and further comprising a door position sensor that determines whether the door is open or closed, the controller determining a period of time lapsing since the door was last closed, the controller operatively connected to the door position sensor and wherein the controller generates the lock position communication responsive when the controller has determined the sensed temperature of the interior of the cabinet has remained above the predetermined temperature and the determined time lapsing since of last door closing is greater than a predetermined amount of time after the door has been closed.

9. The refrigerated enclosure of claim 8 wherein the door lock includes a solenoid for operating the door lock between the locked position and unlocked position responsive to receiving the communication from the controller.

10. The refrigerated cooler of claim 8 further comprising a power supply detector circuit that determines whether a supply of power to the cooler has been interrupted, the controller operatively connected to the power supply detector circuit and wherein the controller generates an unlock position communication responsive to the supply of power being currently detected and wherein at least one of the controller generates a lock position communication responsive to the detection of the interruption of the supply of power and the door lock automatically transitions to the lock position when the supply of power is interrupted.

11. The refrigerated cooler of claim 10 wherein the controller generates an unlock position communication to the door lock to unlock the door when the controller receives an indication from the power supply detector circuit that the supply of power has been restored to the cooler and the controller determines that the temperature of the interior of the cooler has not remained at being greater than the predetermined temperature for a period of time that is greater than a stored predetermined power interruption period of time.

12. The refrigerated cooler of claim 8 further comprising a display operatively connected to the controller indicating an operating status of the cooler including a status indication of the door being in the lock position.

13. The refrigerated cooler of claim 8 further comprising a safety release button disposed in the interior of the cooler, wherein the safety release button operatively coupled to the door lock unlocking the door lock that is in the lock position independent of the received lock position communication from the controller to allow a person trapped in the cooler to open the door when it is locked.

14. The refrigerated cooler of claim 8 wherein the door lock further comprises a key slot that is accessible external to the cabinet, the key slot operable to manually change the position of the door lock between the lock position and the unlock position enabling a person to unlock the door lock independent of whether a supply of power to the cooler has been interrupted or when the door lock has been placed in the lock position by the controller.

15. A refrigerated cooler comprising:

a cabinet having an interior for storing food items requiring refrigeration and a refrigeration unit for cooling the interior of the cabinet;

a controller controlling the refrigeration unit regulating the temperature of the interior of the cabinet, the controller in communication with a temperature sensor that monitors the temperature of the interior of the cabinet and is in communication with the refrigeration unit to control the operation of the refrigeration unit, the controller comparing the monitored temperature with a stored predetermined temperature;

a door attached to the cabinet that selectively provides access to the interior of the cabinet and seals air within the interior of the cabinet;

a door lock including a latching unit and a catch, one of each operatively connected to the cabinet and the door wherein the door lock is adapted to have a lock position and an unlock position responsive to receiving a lock position communication from the controller and wherein in the lock position the lock prevents access to the interior of the cabinet and the stored food items within the interior of the cabinet, the controller generating the lock position communication responsive to the controller determining from the comparing that the monitored temperature of the interior of the cabinet is greater than the predetermined temperature; and a power supply detector circuit that determines whether a supply of power to the cooler has been interrupted, the controller operatively connected to the power supply detector circuit and wherein the controller generates an unlock position communication responsive to the supply of power being currently detected and wherein at least one of the controller generates a lock position communication responsive to the detection of the interruption of the supply of power and the door lock automatically transitions to the lock position when the supply of power is interrupted, wherein the controller includes a timer determining a lapsed time and wherein the controller generates an unlock position communication to the door lock to unlock the door when the controller receives an indication from the power supply detector circuit that the supply of power has been restored to the cooler and the controller determines that the temperature of the interior of the cooler has not remained at being greater than the predetermined temperature for a period of time that is greater than a stored predetermined power interruption period of time.

16. The refrigerated enclosure of claim 15 wherein the door lock includes a solenoid for operating the door lock between the locked position and unlocked position responsive to receiving the communication from the controller.

17. The refrigerated enclosure of claim 15 wherein the controller generates the lock position communication to the door lock when the controller determines that the interior of the cabinet has increased in temperature beyond the predetermined temperature for a period of time as determined from the timer that is greater than a predetermined period of time as stored by the controller.

18. The refrigerated cooler of claim 15 further comprising a door position sensor that determines whether the door is open or closed, the controller operatively connected to the door position sensor and wherein the controller determines a period of time for the door being open and generates the lock position communication responsive to the controller determining the sensed temperature of the interior of the cabinet has remained above the predetermined temperature and the determined door open period of time is greater than a stored predetermined period of door open time.

19. The refrigerated cooler of claim 15 further comprising a door position sensor that determines whether the door is open or closed, the controller determining a period of time lapsing since the door was last closed, the controller operatively connected to the door position sensor and wherein the controller generates the lock position communication responsive when the controller has determined the sensed temperature of the interior of the cabinet has remained above the predetermined temperature and the determined time lapsing since of last door closing is greater than a predetermined amount of time after the door has been closed.

20. The refrigerated cooler of claim 15 further comprising a display operatively connected to the controller indicating an operating status of the cooler including a status indication of the door being in the lock position.

21. The refrigerated cooler of claim 15 further comprising a safety release button disposed in the interior of the cooler, wherein the safety release button operatively coupled to the door lock unlocking the door lock that is in the lock position independent of the received lock position communication from the controller to allow a person trapped in the cooler to open the door when it is locked.

22. The refrigerated cooler of claim 15 wherein the door lock further comprises a key slot that is accessible external to the cabinet, the key slot operable to manually change the position of the door lock between the lock position and the unlock position enabling a person to unlock the door lock independent of whether a supply of power to the cooler has been interrupted or when the door lock has been placed in the lock position by the controller.

23. A refrigerated cooler comprising:

a cabinet having an interior for storing food items requiring refrigeration and a refrigeration unit for cooling the interior of the cabinet;

a controller controlling the refrigeration unit regulating the temperature of the interior of the cabinet, the controller in communication with a temperature sensor that monitors the temperature of the interior of the cabinet and is in communication with the refrigeration unit to control the operation of the refrigeration unit, the controller comparing the monitored temperature with a stored predetermined temperature;

a door attached to the cabinet that selectively provides access to the interior of the cabinet and seals air within the interior of the cabinet;

a door lock including a latching unit and a catch, one of each operatively connected to the cabinet and the door wherein the door lock is adapted to have a lock position and an unlock position responsive to receiving a lock position communication from the controller and wherein in the lock position the lock prevents access to the interior of the cabinet and the stored food items within the interior of the cabinet, the controller generating the lock position communication responsive to the controller determining from the comparing that the monitored temperature of the interior of the cabinet is greater than the predetermined temperature; and a safety release button disposed in the interior of the cooler, wherein the safety release button operatively coupled to the door lock unlocking the door lock that is in the lock position independent of the received lock position communication from the controller to allow a person trapped in the cooler to open the door when it is locked.

24. The refrigerated enclosure of claim 23 wherein the door lock includes a solenoid for operating the door lock between the locked position and unlocked position responsive to receiving the communication from the controller.

25. The refrigerated enclosure of claim 23 wherein the controller includes a timer determining a present time or a lapsed time and wherein the controller generating the lock position communication to the door lock when the controller determines that the interior of the cabinet has increased in temperature beyond the predetermined temperature for a period of time as determined from the timer that is greater than a predetermined period of time as stored by the controller.

26. The refrigerated cooler of claim 23 wherein the controller includes a timer determining a present time or a lapsed time and further comprising a door position sensor that determines whether the door is open or closed, the controller operatively connected to the door position sensor and wherein the controller determines a period of time for the door being open and generates the lock position communication responsive to the controller determining the sensed temperature of the interior of the cabinet has remained above the predetermined temperature and the determined door open period of time is greater than a stored predetermined period of door open time.

27. The refrigerated cooler of claim 23 wherein the controller includes a timer determining a present time or a lapsed time and further comprising a door position sensor that determines whether the door is open or closed, the controller determining a period of time lapsing since the door was last closed, the controller operatively connected to the door position sensor and wherein the controller generates the lock position communication responsive when the controller has determined the sensed temperature of the interior of the cabinet has remained above the predetermined temperature and the determined time lapsing since of last door closing is greater than a predetermined amount of time after the door has been closed.

28. The refrigerated cooler of claim 23 further comprising a power supply detector circuit that determines whether a supply of power to the cooler has been interrupted, the controller operatively connected to the power supply detector circuit and wherein the controller generates an unlock position communication responsive to the supply of power being currently detected and wherein at least one of the controller generates a lock position communication responsive to the detection of the interruption of the supply of power and the door lock automatically transitions to the lock position when the supply of power is interrupted.

29. The refrigerated cooler of claim 28 wherein the controller includes a timer determining a lapsed time and wherein the controller generates an unlock position communication to the door lock to unlock the door when the controller receives an indication from the power supply detector circuit that the supply of power has been restored to the cooler and the controller determines that the temperature of the interior of the cooler has not remained at being greater than the predetermined temperature for a period of time that is greater than a stored predetermined power interruption period of time.

30. The refrigerated cooler of claim 23 further comprising a display operatively connected to the controller indicating an operating status of the cooler including a status indication of the door being in the lock position.

31. The refrigerated cooler of claim 23 wherein the door lock further comprises a key slot that is accessible external to the cabinet, the key slot operable to manually change the position of the door lock between the lock position and the unlock position enabling a person to unlock the door lock independent of whether a supply of power to the cooler has been interrupted or when the door lock has been placed in the lock position by the controller.

* * * * *